US006483062B1

(12) United States Patent
Herdegen et al.

(10) Patent No.: US 6,483,062 B1
(45) Date of Patent: Nov. 19, 2002

(54) PUSH-PULL SWITCH

(75) Inventors: Reinhard Herdegen, Amberg (DE); Peter Weiss, Birgland (DE); Rudolf Zimmermann, Sulzbach-Rosenberg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/890,073

(22) PCT Filed: Jan. 13, 2000

(86) PCT No.: PCT/DE00/00120

§ 371 (c)(1),
(2), (4) Date: Jul. 26, 2001

(87) PCT Pub. No.: WO00/45402

PCT Pub. Date: Aug. 3, 2000

(30) Foreign Application Priority Data

Jan. 26, 1999 (DE) ..... 199 03 031

(51) Int. Cl.[7] ..... H01H 1/26

(52) U.S. Cl. ..... 200/538; 200/539; 200/329; 200/318.2

(58) Field of Search ..... 200/538, 539, 200/540, 541, 542, 329, 318.2, 330, 529; 74/503, 504

(56) References Cited

U.S. PATENT DOCUMENTS

| | | | | | |
|---|---|---|---|---|---|
| 2,836,686 | A | * | 5/1958 | Barden et al. | 200/153 |
| 4,916,276 | A | * | 4/1990 | Sasaki | 200/524 |
| 5,345,050 | A | * | 9/1994 | Branch et al. | 200/341 |
| 6,153,841 | A | * | 11/2000 | Hart | 200/314 |
| 6,268,577 | B1 | * | 7/2001 | Marquardt et al. | 200/330 |

FOREIGN PATENT DOCUMENTS

| | | |
|---|---|---|
| DE | 40 36 671 A1 | 5/1992 |
| DE | 296 15 428 U1 | 2/1997 |
| DE | 195 44 702 A1 | 6/1997 |
| FR | 2444329 | 7/1980 |
| FR | 2 444 329 | 7/1980 |
| GB | 1225496 | 3/1971 |

* cited by examiner

*Primary Examiner*—Elvin Enad
*Assistant Examiner*—Kyung S. Lee
(74) *Attorney, Agent, or Firm*—Harness, Dickey & Pierce, P.L.C.

(57) ABSTRACT

A push-pull switch includes an actuating mechanism whose actuating tappet is engaged in a thread in the handle. By this arrangement, a pulling movement on the handle is converted into a rotational movement of the actuating tappet. As such, balls mounted as latching elements in the actuating tappet can be released gently from a secure latching position in the ON state.

6 Claims, 3 Drawing Sheets

PUSH-PULL SWITCH

This application is the national phase under 35 U.S.C. §371 of PCT International Application No. PCT/DE00/00120 which has an International filing date of Jan. 13, 2000, which designated the United States of America, the entire contents of which are hereby incorporated by reference.

FIELD OF THE INVENTION

The invention relates to a push-pull switch with an actuating mechanism which has a handle, with an actuating tappet being connected to the handle in order to actuate a switching element and a bezel, in which the actuating tappet is mounted such that it can be displaced axially. Preferably, the actuating tappet includes a latching element which latches on the bezel during ON actuation.

BACKGROUND OF THE INVENTION

A push-pull switch of the generic type has been supplied on the electrical market for years. The system used in this case operates with latches which permit two or more stop positions of the handle in the axial direction, that is to say in the direction of the switching element paths. The balls used here as latching elements move to and fro on the same path between the ON and the OFF position. The balls snap under spring load from one valley in the ON position, over a peak, into a valley located behind for the OFF position and back on the same path. In this case, the retaining force of the latching is reduced by the restoring forces of the switching elements actuated. It is therefore necessary to ensure an adequately great difference between the force actually required to snap back and the sum of the maximum restoring forces of the switching elements which occur. For the majority of fittings, the resetting force is overdimensioned, which means that the material is continuously highly stressed. Consequently, the service life is restricted and the operating comfort is reduced by the extremely hard latching.

SUMMARY OF THE INVENTION

The invention is therefore based on the object of providing a push-pull switch of the type mentioned above for electromechanical command devices which cannot be reset by the contact pressure of the switching elements actuated and offers the highest possible degree of functional reliability and operating comfort.

The object is achieved by the actuating tappet being engaged in a thread in the handle, as a result of which a pulling movement on the handle can be converted into a rotational movement of the actuating tappet in order to release the latch. This solution, according to the invention in principle, makes it possible to provide other paths for the latching elements in the ON and OFF switching operations, in order to ensure reliable latching, avoiding resetting, in the ON position. The aforementioned solution additionally offers the advantage that no additional part is required for rotational unlocking.

A particularly advantageous embodiment arises if the bezel has a recess which extends tangentially and tapers and in which, in the ON position, latching elements embodied as balls are accommodated. This embodiment permits rotational unlocking, in which the actuating tappet is rotated and, as a result, the latching elements are released gently over the contour of the recess and are moved back into their initial position, that is to say the OFF position.

In order to achieve particularly reliable latching of the balls, it is advantageous if the balls, in the ON position, are accommodated in the recess by more than half their diameter. Even severe impacts and vibration in conjunction with high restoring forces from the switching elements actuated cannot lead to resetting in the case of such an embodiment.

In addition, it is advantageous if a compression torsion spring is clamped in between the bezel and the actuating tappet, since releasing the latch may be assisted by the spring in a simple way.

BRIEF DESCRIPTION OF THE DRAWINGS

An exemplary embodiment of the invention will be explained in detail below using a drawing, in which.

DETAILED DESCRIPTION OF THE PREFERRED EMBODIMENTS

Figure 1:
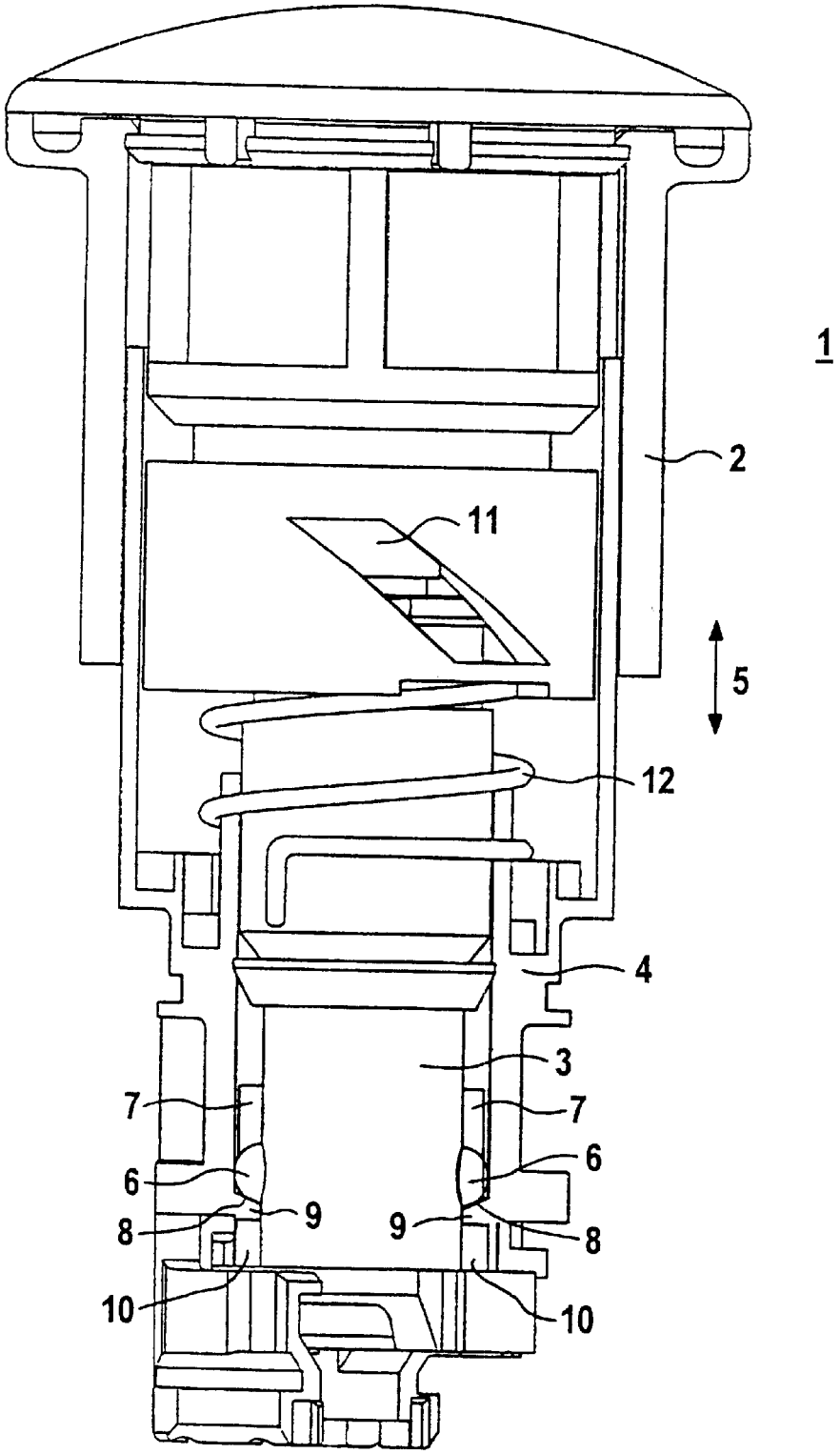
FIG. 1 shows a sectional illustration of an actuating mechanism according to the invention for a push-pull switch, in the OFF position.
Figure 2:
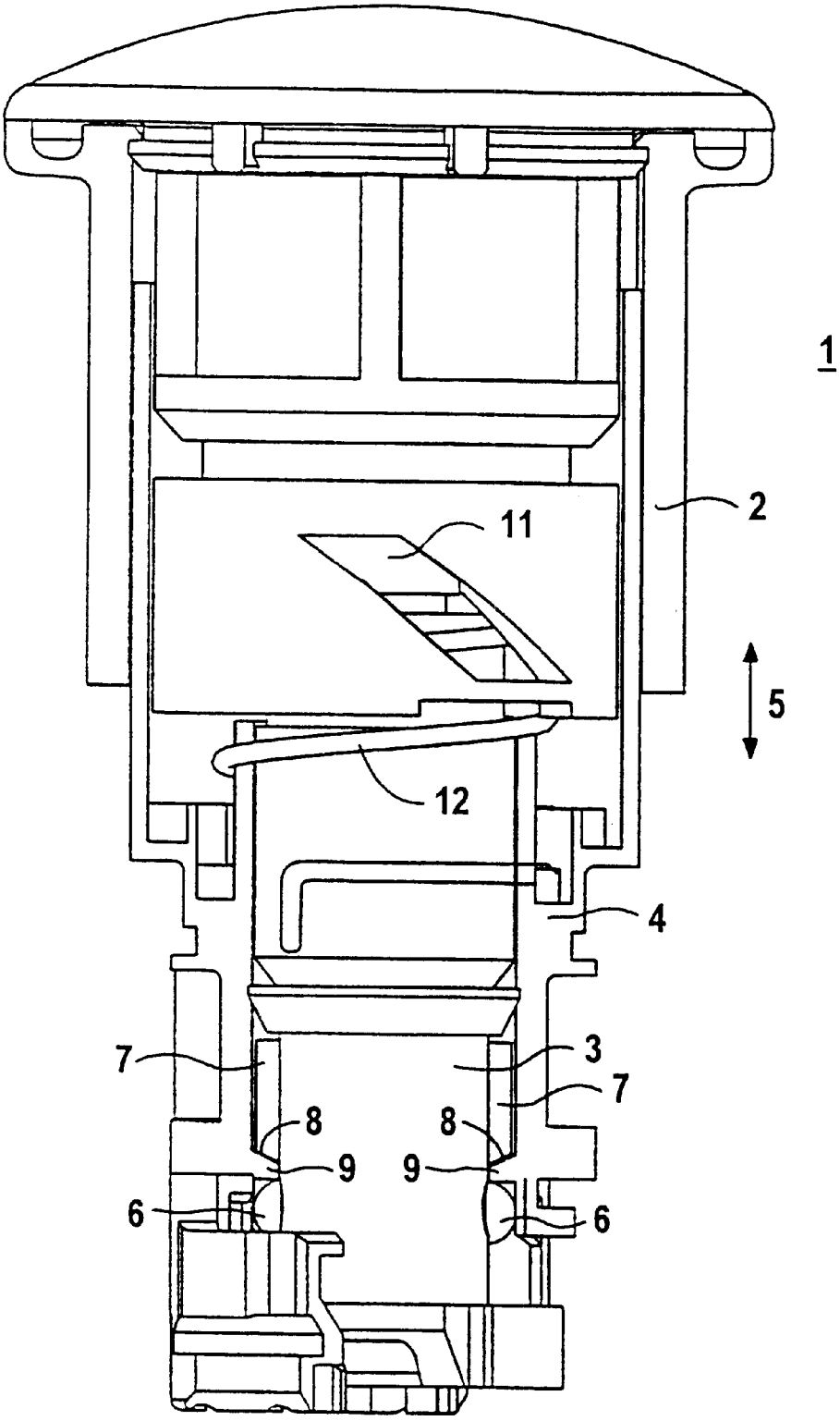
FIG. 2 shows a sectional illustration of the actuating mechanism according to FIG. 1 in the ON position.

FIGS. 1, 2 show a sectional illustration of an actuating mechanism 1 according to the invention for a push-pull switch. In FIG. 1, the actuating mechanism I is illustrated in the initial, "OFF" position. The actuating mechanism 1 comprises a handle 2, an actuating tappet 3 connected to the latter to actuate a switching element, and a cylindrical bezel 4. The handle 2 with the actuating tappet 3 is mounted such that it can be displaced axially in the actuating direction according to arrow 5.

Figure 3:
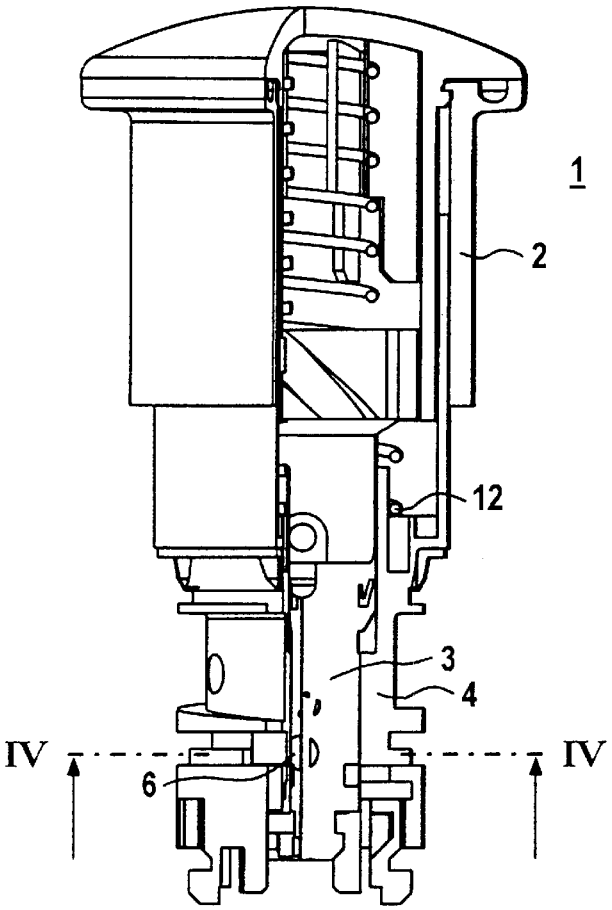
FIG. 3 shows a further sectional illustration of the actuating mechanism according to FIG. 1 in the ON position and FIG. 4 shows a cross-sectional view of the actuating mechanism in the area of the latch.

The actuating tappet 3 is preferably provided with spring-mounted balls 6 as latching elements which, in the OFF position according to FIG. 1, engage in an upper recess 7 on the inner wall of the bezel 4. The balls 6 rest on a chamfer 8 of a projection 9, which is adjoined downward by a further recess 10. The transition from the projection 9 to the further recess 10 is designed to be at right angles to the actuating direction. The further recess 10 serves as a latching valley, in which the balls 6 latch when the handle 2 is actuated, and therefore hold the actuating tappet 3 in the ON position according to FIGS. 2 and 3.

Figure 4:
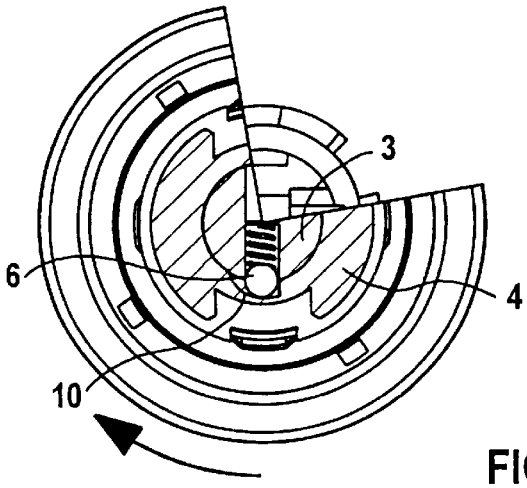

The recess 10 preferably extends tangentially on the inner circumference of the bezel 4, with a taper according to FIG. 4. The handle 2 is provided with a steep thread 11, with which the actuating tappet 3 is in engagement. Finally, a pressure torsion spring 12 is preferably supported with its lower end on the bezel 4 and with its upper end on the actuating tappet 3.

In the following text, the mode of action of this actuating mechanism will be explained. When the handle 2 is actuated in the OFF position, the balls 6 are pressed into the chamfer 8 of the projection 9 and, after overcoming the projection 9, latch into the recess 10 as illustrated in FIG. 2. In the ON position according to FIG. 2, because of the latching on the rectangular shoulder on the projection 9, the balls 6 and, with them, the actuating tappet 3, are held reliably in the ON position. This means that the push-pull switch cannot be reset by the contact pressure from the switching elements actuated by the actuating tappet 3. The latch can be released only by pulling on the handle 2. In the process, the pulling movement, that is to say the axial movement of the handle 2, is converted via the steep thread 11 into a rotational movement of the actuating tappet 3. The balls 6 are pressed in by the outer contour of the tapering recess 10 according to FIG. 3, and the latching is cancelled as a result. During this operation of releasing the latching, the pressure torsion spring 12 acts in a supportive manner.

In the above-described solution according to the invention, the balls 6, as latching elements, are guided back on a different path from ON to OFF than from OFF to ON, in such a way that only deliberate handling on the operating part makes this possible. With the ON actuation, irreversible latching in the axial direction is completed, since the balls 6 snap by more than half their diameter into the recess 10 behind the projection 9 at right angles to the actuating direction according to arrow 5, and can only be released from said recess 10 again in the tangential direction. This is not possible with the restoring forces, acting in the axial direction, from the switching elements acting on the actuating tappet 3, which provides extreme security against erroneous resetting as a result of impact, vibration etc.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A push-pull switch comprising:

an actuating mechanism with a handle;

an actuating tappet connected to the handle to actuate a switching element; and a bezel, in which the actuating tappet is mounted such that it can be displaced axially, wherein the actuating tappet includes a plurality of latching elements which latch on the bezel during ON actuation, and wherein the actuating tappet engages with a thread in the handle, as a result of which a pulling movement on the handle converts into a rotational movement of the actuating tappet in order to release the latch.

2. The push-pull switch as claimed in claim 1, wherein the bezel includes a recess which extends tangentially and tapers and in which latching elements, embodied as balls, are accommodated in the ON position.

3. The push-pull switch as claimed in claim 2, wherein, in the ON position, the balls are accommodated by more than half their diameter in the recess.

4. The push-pull switch as claimed in claim 3, further comprising:

a pressure torsion spring, clamped in between the bezel and the actuating tappet.

5. The push-pull switch as claimed in claim 2, further comprising:

a pressure torsion spring, clamped in between the bezel and the actuating tappet.

6. The push-pull switch as claimed in claim 1, further comprising:

a pressure torsion spring, clamped in between the bezel and the actuating tappet.

* * * * *